US006211133B1

(12) United States Patent
Chesky

(10) Patent No.: US 6,211,133 B1
(45) Date of Patent: Apr. 3, 2001

(54) BITUMINOUS SUBSTANCE REMOVAL COMPOSITION

(75) Inventor: Sheldon R. Chesky, Clarksville Valley, MO (US)

(73) Assignee: Biospan Technology, Inc, Washington, DC (US)

( * ) Notice: Subject to any disclaimer, the term of this patent is extended or adjusted under 35 U.S.C. 154(b) by 0 days.

(21) Appl. No.: 09/624,745

(22) Filed: Jul. 25, 2000

(51) Int. Cl.[7] ..... C11D 17/00; B08B 7/00; C23G 5/00; C23G 1/00

(52) U.S. Cl. ..... 510/366; 510/365; 134/40

(58) Field of Search ..... 510/365, 366; 134/40

(56) References Cited

U.S. PATENT DOCUMENTS 1,248,071 * 11/1917 Bule ..... 510/366
2,340,977 * 2/1944 Nusslein et al. ..... 8/139
2,913,418 * 11/1959 Sohngen et al. ..... 252/163
3,914,132 * 10/1975 Sutton ..... 134/40
4,108,681 * 8/1978 Lawson et al. ..... 134/20
5,171,475 * 12/1992 Freiesleben ..... 252/312
5,389,156 * 2/1995 Mehta et al. ..... 134/10
5,549,839 * 8/1996 Chandler ..... 510/365
5,961,730 * 10/1999 Salmonsen et al. ..... 134/4
6,090,769 * 7/2000 Vlasblom ..... 510/365
6,093,689 * 7/2000 Vlasblom ..... 510/365
6,126,757 * 10/2000 Kinnaird ..... 134/37

* cited by examiner

*Primary Examiner*—Yogendra Gupta
*Assistant Examiner*—John M Petruncio

(57) ABSTRACT

A non-toxic, non-hazardous, environmentally safe composition provides an effective, fast acting cleaning solution for removal of tar, oils, asphalt and other bituminous materials from industrial equipment surfaces. The composition is a mixture of a carrier monocyclic monoterpene and a nonionic surfactant such as an alkylphenol ethoxylate. The mixture is applied directly to surfaces to be cleaned, and rinsed with water in the absence of mechanical intervention.

12 Claims, 1 Drawing Sheet

% Asphalt Removed

BITUMINOUS SUBSTANCE REMOVAL COMPOSITION

FIELD OF THE INVENTION

The present invention relates to novel solvent systems capable of dissolving bituminous buildup on paving and roofing equipment. These solvents are characterized in being non-hazardous, non-toxic, and environmentally safe. Mixtures comprising noncyclic monoterpenes and anionic detergents provide effective cleaning and conditioning.

BACKGROUND OF THE INVENTION

Bituminous products are widely used in the construction field, and constitute one of the major commodity products in building and road construction. These materials are derived from the residue remaining after crude oil is refined to remove various distillates. Over the past twenty years, there have been many innovations in bituminous materials used in roofing and paving. The principle objectives of these developments are to increase strength and durability, ductility, reduce "creep", cracking, and surface wear. A typical asphalt shingled roof requires replacement after 12–18 years, and road damage to asphalt may be detected within even the first year of paving. New compositions have substantially extended the lifespan of these materials Many of the new asphalt materials contain synthetic polymers to create chemical links (both covalent and non-covalent interactions) between the long chain hydrocarbons, thus providing molecular strength. U.S. Pat. No. 5,556,900 discloses a thermoplastic polymer-linked asphalt in which the asphalt is reacted with an epoxide polymer resulting in a composition with low gelation, high emulsion forming capacity, and improved rheology. Heat treatment at 135 degrees C., results in covalent bonding between the polymer and the asphalt. In other polymer-containing bitumens, there is typically non-covalent adhesion binding of components.

For example, U.S. Pat. No. 5,473,000 teaches a method for improving bitumen by adding to asphalt a thermoplast or thermoelastomer, and a wood resin, resulting in enhanced binding properties. A linear polyethylene modified asphaltic composition is disclosed in U.S. Pat. No. 4,868,233, which has improved storage stability and creep resistance. Another polymer additive approach is disclosed in U.S. Pat. No. 5,322,867 for a bituminous mixture containing a polymer comprising one block of a conjugated diolefin methacrylate and a block of a functionalized acrylic monomer, giving improved properties over neat asphalt.

Some of the most significant developments in asphalt and tar composition involve various strategies for combining the strength and resiliency of latex polymers with bituminous materials. U.S. Pat. Nos. 4,485,201 and 5,436,285 disclose incorporation of finely divided rubber into asphalt compositions. In a variation, U.S. Pat. No. 5,811,477 utilizes reclaimed rubber particles, latex rubber, preferably styrene butadiene, and an aqueous asphalt emulsion to achieve low temperature processing, thereby reducing environmental contamination from latex volatiles.

U.S. Pat. Nos. 5,451,621 and 5,973,037 teach the infusion of particular latex polymers characterized as styrene-ethylene-butylene-styrene block copolymers into bituminous products, including asphalt, to raise the softening point of the blend and increase resistance to ultraviolet radiation, ozone, and fatigue. In yet another application of rubber in the asphalt art, U.S. Pat. No. 5,704,971 discloses the pretreatment of crumb rubber with peroxide, adding the treated rubber to asphalt in the presence of a compatibilized binder to produce an asphalt having improved settling properties of the binder, and reduced tendency to ravel.

While the objectives of improved durability, ductility, strength, and other related performance improvements, modification of bituminous substances has brought about new problems. The same molecular interactions which achieve enhanced stability and binding efficiency of the asphalt components, especially in the class of latex polymer blends known as SuperPave, also render the material extremely difficult to remove from paving equipment such as asphalt distributors and oilers, spreaders and the like, roofing manufacturing equipment and applications equipment. The buildup of these materials on equipment, particularly painted and bare metallic surfaces, leads to uneven dispensing, plugged nozzles, and impaired release of asphalt from distributors and spreaders. In many instances uneven distribution of asphalt in pavement requires repaving at substantial cost to the industry.

Classically, equipment has been cleaned by the use of common petroleum distillates such as kerosene, diesel fuel, or more purified fractions, and wood resin compounds such as turpentine. Usually cleaning with these substances requires mechanical intervention as by brushing, rubbing with cloth or abrasives. Use of such conventional substances has led to environmental contamination and exposure of cleanup personnel to toxic, and even carcinogenic substances. Moreover, the extreme intractability of the advanced polymer blended bitumens to conventional cleaning solvents increases the volumes needed to soften and remove them from machinery surfaces. Incomplete removal of the asphalt results from the difficulty of conventional solvents to penetrate the asphalt matrix. This increases costs of cleanup to the industry, in terms of time and materials, and machine efficiency.

Much attention has been given to development of asphalt release agents that preventing sticking of bituminous materials to machinery. U.S. Pat. No. 5,900,048 discloses a release composition combining lethicin with a dispersing agent such as propylene glycol ethers or ether acetates. Other release agents have been proposed such as a combination of polycycloaliphatic amines and polyalkylene glycols (U.S. Pat. No. 5,961,730), cleaning by hydrogen peroxide together with iron catalysts (U.S. Pat. No. 5,725,687), fatty acids in combination with preferably an anionic surfactant (U.S. Pat. No. 5,494,502, and a water based solution of magnesium chloride, a phosphate ester, an anionic alcohol surfactant (U.S. Pat. No. 5,322,554).

All of the foregoing release technologies have as a common strategy, forming a slippery barrier coating on a metal surface to prevent adhesion of asphalt, thus allowing it to slide readily from the treated surface. None of these compounds can be expected to appreciably penetrate the asphalt itself, except as a softener at the immediate undersurface. Thus, effective removal of asphalt already set on machinery is not addressed. A need exists for an effective asphalt removal agent, especially for modern bituminous polymer-containing formulations.

SUMMARY OF THE INVENTION

Immediately after compounding, asphalt is ductile and somewhat flowable, but stiffens and becomes less compactable as it sets. When fully set, asphalt is a dense mass, made more cohesive and fibrous by inclusion of polymer strands and other additives. These asphalts provide a formidable barrier to penetration of water and organic solvents. Such compositions bind tightly to solid surfaces, and can be scraped off only with great difficulty.

It is therefore an object of the present invention to provide an agent capable of penetrating and dissolving bitumens in situ without recourse to mechanical interventions such as chipping, wiping, brushing, or grinding. It is a further object to provide an agent which is easily applied to tar and asphalt coated metal or plastic surfaces without damage to the surface. Such agent will be fast acting and result in effectively complete removal. Most importantly, it is an object of the invention to provide an essentially harmless agent which is environmentally safe, non-toxic to clean-up personnel, and biodegradable.

The present composition comprises a mixture of one or more monocyclic monoterpenes (preferably one or more para-menthane dienes) which act as a carrier solvent, and a non-ionic detergent having sufficient hydophobicity to penetrate the bitumen matrix, and sufficient hydrophilicity to be soluble in the carrier. The detergent is preferably selected from alkylphenol ethoxylates and alkyl alcohol ethoxylates, or combinations of these substances. The detergent content is at least 2% by weight (w/w) but may vary from about 2% (w/w) to about 12%w/w).

The alkylphenol ethoxylates of the present invention comprise linear hydrocarbon moieties of chain length 1–13 carbon atoms and ethoxy repeat units ranging linearly from 1 to 23 groups. The structure is defined by the following formula:

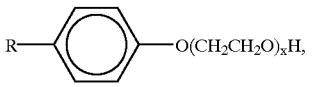

wherein R is a linear alkyl radical, $CH_3—(CH_2)_n—$, n is an integer 1–12, and x is an integer 2–23.

The alkyl alcohol ethoxylates of the invention have a structure defined by the formula: $CH_3(CH_2)_x—CH_2—O(CH_2CH_2O)_yH$ wherein x is an integer 2–16 and y is an integer 2–14.

According to the method of the present invention, bituminous material may be effectively removed from solid surfaces to which they are bound, by applying to such surfaces the compositions disclosed herein, allowing the solvent compositions to incubate at temperatures ranging from about 1 degrees Fahrenheit (F.) to about 150 degrees F. on the surface of the adherent bitumen for at least 2 minutes up to about 1 hour, and rinsing with water. The application step may be repeated one or more times prior to a final water rinse.

In other embodiments, the present invention provides methods for removing asphalt or tar from a solid surface comprising providing a solid surface having tar or asphalt thereon and an undiluted mixture of a para-menthane diene and at least 2% w/w of a surfactant selected from the group consisting of an alkylphenol ethoxylate and an alkyl alcohol ethoxylate and combinations thereof; and applying the undiluted mixture of a para-menthane diene and at least 2% w/w of a surfactant selected from the group consisting of an alkylphenol ethoxylate and an alkyl alcohol ethoxylate and combinations thereof to the surface under conditions such that the tar or asphalt is removed.

DETAILED DESCRIPTION OF THE PREFERRED EMBODIMENTS

Figure 1:
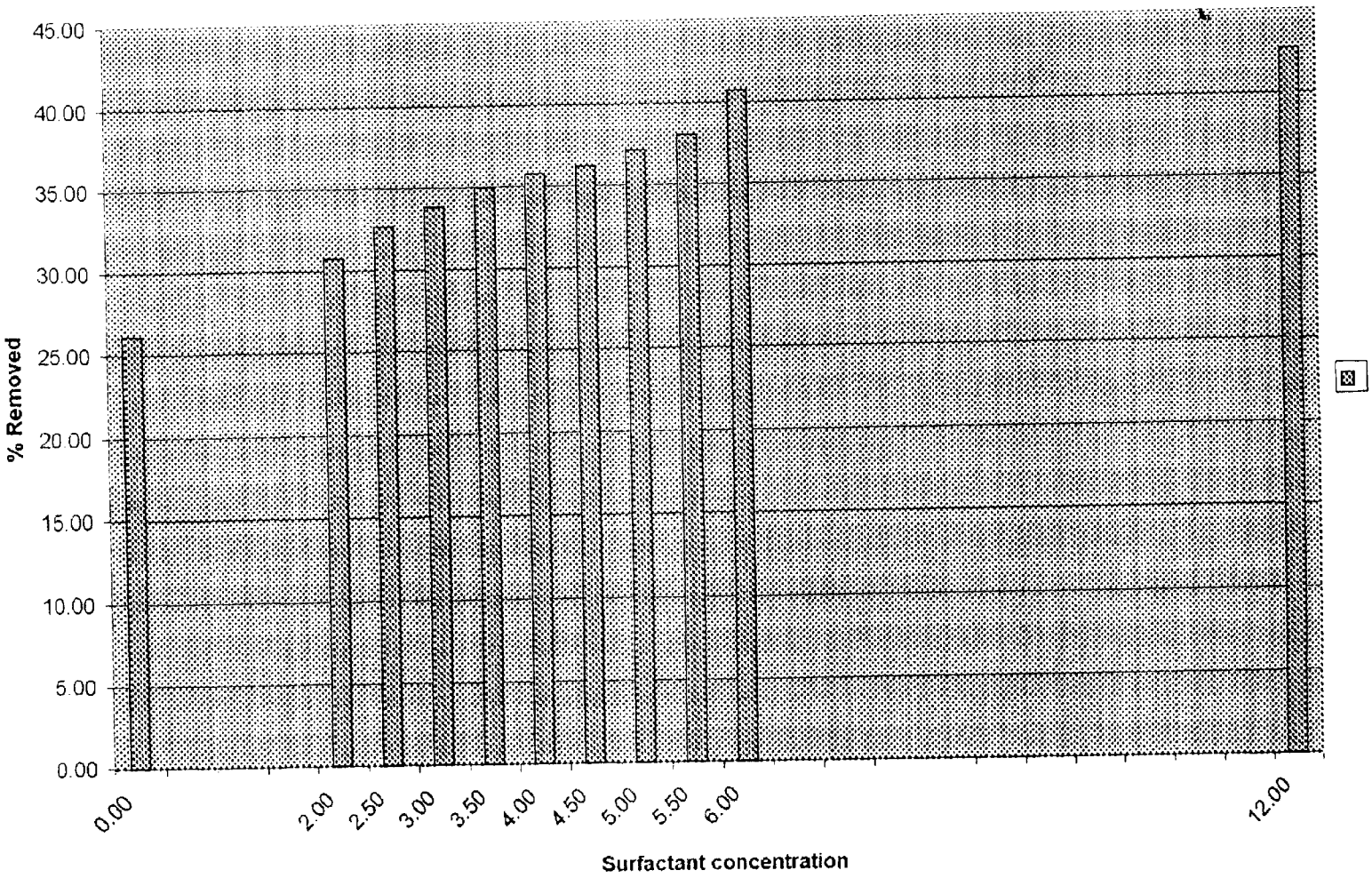
FIG. 1 is rectilinear plot showing the extent of asphalt removal as a function of the detergent content of the removal composition.

In bitumen removal from equipment surfaces, the principal challenge is to penetrate the adherent material. Since asphalt and tar are endogenous to and ultimately obtained from crude oil, it has been assumed that the lighter refined fractions of oil would be the solvents of choice in "resolubilizing" the asphalt and tar fractions; hence, the widespread use petroleum distillates in cleaning tar and asphalt laden machinery. In addition to kerosene, distilled spirits, fuel oil, and diesel fuel, a few commercially formulated products have been on the market. Most of these products contain petroleum distillates immisible in water, and Applicant believes that an aqueous based detergent system may have been used. None of these are fully effective.

The present composition contains neither petroleum distillates nor water. However, the carrier monocyclic monoterpenes are highly hydrophilic and miscible in water. Thus, the water rinse carries away the phase compatible carrier after the dissolved bitumen has been absorbed by the hydrophobic alkyl moiety of the surfactant. While Applicant does not wish to be bound by any particular theory, it is believed that the hydrophilic moiety of the surfactant serves to anchor the molecule bearing its hydrocarbon absorbed hydrophobic moiety to the carrier stream.

The monocyclic monoterpenes belong to the family of substances known as "essential oils". These compounds were distilled from aqueous infusions of various plant tissues such as flowers, fruits and leaves. The monocylic monoterpenes have the general menthane structure:

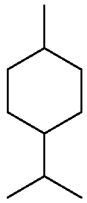

Some fourteen diene isomers having the para-menthane skeletal structure are possible, but only six occur in nature. In the present invention, three of the naturally occurring isomers are preferred: limonene (either as d-limonene or d1-limonene (dipentene)), terpinolene, and gama-terpinene. The isopropenyl-1-methyl cyclohexenes as a class are highly preferred and are functionally equivalent in the present composition. Limonene (4-isopropenyl-1-methyl-cyclohexene) is most preferred because of its excellent handling and blending properties, pleasant fragrance, and commercially available quantities.

Although the carrier properties of all the naturally-occurring monocyclic monoterpenes are expected to be similar (they have similar boiling points, solvency characteristics, and chemical properties), the aliphatic, un-derivativized isomers (such as the preferred class, the isopropenyl-1-methyl cyclohexenes) are much preferred over those having side chains appended to the pentane ring. "Un-derivatized" isomer means an aliphatic chemical structurally characterized in having a para-pentane ring and two double bonds.

Also included in the scope of the present invention are mixtures of para-pentane diene isomers obtained by molecular rearrangments catalyzed by acids, bases, or absorption onto surfaces such as silica gel. Such catalytic rearrangments are well known in fatty acid chemistry and may favor predominance of conjugated isoforms. Any such mixtures are suitable for use in the present composition.

Of the dozens of potential surfactant candidates, the alkylphenol ethoxylates and alkyl alcohol ethoxylates were found in the present invention to have superior cleaning and stability properties. Being nonionic they are highly compatible with the non-ionic para-menthane diene carriers.

The preferred class of alkylphenol ethoxylates are linear molecules having a linear alkyl radical of 2 to 13 methylene groups, linked through a phenolic radical to an ethoxy chain of 2 to 23 linearly repeating units. The choice of alkyl and ethoxy chain length is influenced somewhat by the composition of the bitumen. The preferred surfactant is the 1-nonylphenol-6-ethoxylate having an average of 9.5 ethoxy groups. This material is readily available commercially, and known in the art as SURFONICTM™ N-95, manufactured by the Huntsman Corporation.

A second class of preferred surfactants are the alkyl alcohol ethoxylates having a formula: $CH_3(CH_2)_xCH_2—O(CH_2CH_2O)_yH$ wherein x is an integer from 2 to 16 and y is an integer 2 to 23. In a preferred compound x is 14 and y is 8, and is known in the art as L24-8. A series of compounds of different alkyl and ethoxy chain length are commercially available from Huntsman Corporation.

The surfactant may be added to carrier at concentrations up to 20% without appreciably altering viscosity and coating properties. However, the cleaning action is optimal between 2 and 6%w/w. Although cleaning efficacy has been tested up to 12%, no apparent advantage is served at the higher concentrations. Therefore, any concentration of surfactant is encompassed by the invention up to about 20%, a working range of at least about 2% up to about 10% is highly efficacious. Higher concentrations contribute little except higher costs of manufacture.

In the event that it is suspected that a surfactant of different alkyl or ethoxy chain length may improve performance, some minor experimentation may be carried out by those skilled in the art. In general, if a greater degree of hydrophobicity is desired, it is recommended that the ethoxy chain length be extended also. In a particular application, if a longer alkyl chain is employed, a 9.5 unit ethoxy chain should be tested first. If no clouding of the carrier is detected, the composition can be used directly. Such tests can readily be carried out in the field, or by adopting the laboratory scale assay set forth in the Examples. There will be no need of undue experimentation, as the tests are easy to perform, and a wide range of surfactants of the disclosed classes are commercially available.

Production of commercial quantities of the present composition is simple and straightforward. The carrier is placed in a mixing vessel, a predetermined amount of surfactant is added, and the components are blended to uniformity by mechanical agitation, or by a re-circulating pump.

In the method of the present invention asphalt, tar or other bituminous material can be removed effectively from a solid surface by contacting the surfaces with the cleaning composition, incubating at 1–150 degrees F. for 3–10 minutes, applying a second or subsequent coating of the solvent, incubating for another or subsequent 3–10 minute period, and finally, rinsing with water. Contacting is most conveniently achieved a by simple spray, taking care to cover all exposed surfaces. An ordinary garden sprayer available at most ordinary hardware stores is quite adequate. Alternatively, application may be made by wiping, sponging, dipping or submerging small parts, tools, or pieces of machinery, and maintaining the exposure for commensurate periods, followed by a water rinse. Mechanical intervention as by rubbing, scrubbing, wire brushing, and the like is unnecessary, and may interfere with the solvent action. Another application contemplated by the invention is removal of crude oil buildup on oil rigs, and drilling parts.

The present composition is effective for removing bituminous residues, even in situations where machinery maintenance has been neglected and the deposits tar, asphalt, and oil have been allowed to build up over time. All manner of solid surfaces may be cleaned including metal, painted metal, certain plastics, glass, ceramics, wood, natural or synthetic fabric. It is safe for contact with skin since it is non-corrosive, non-toxic, and non-irritating. Caution should be exercised in contacting certain plastics. It is safe for polyethylene or polyolefin plastics but it will dissolve polycarbonate and polystyrene plastics. In the water rinse step, immersion or rinsing by direct spray is adequate, although the use of a pressure spray 100–300 psi is recommended, and a high pressure spray of greater than 1000 psi is preferred.

Other advantages of the present invention will be apparent from the Examples which follow.

EXAMPLES

After numerous field tests of the present composition were conducted, and efficacy in tar and asphalt removal was reproducibly ascertained, a laboratory scale assay was designed to quantitate cleaning efficiency in comparison with conventional cleaning agents, and to optimize the amount of surfactant to be added to the carrier.

Example 1

A. Preparation of Test Strips

The assay utilizes test strips of stainless steel with dimensions 1.5 inches×2.0 inches×1/32 inches. Immersions in solvents were carried out by placing the strips in clamps and immersing two thirds of the total area of the strip. This provides a total uniform area of exposure of 2.0 square inches (the 1/32 inch thickness of the strip was disregarded. The strips were desiccated and weighed with the clamp assembly, so that the strip itself would not be handled.

The asphalt used in these experiments was a standard commercially available material containing latex polymers called CRS28 manufactured by Patterson Oil Company, Sullivan, Mo. Upon procurement, each batch was cured by heating in a conventional laboratory oven for 7 days at 200 degrees F.

A bath of the cured latex polymer-containing SuperPave asphalt was heated to 175–180 degrees F. The strips were immersed in the molten asphalt to provide 2.0 square inches of exposure. Exposure time was 2–3 seconds. The strips were cooled to room temperature and desiccated for 24 hours, and weighed. Each data point is the arithmetic average of ten strips treated identically.

B. Assay

The strips were immersed in the test solvents so that the entire asphalt coated areas were exposed to the solvent. The strips were withdrawn from the solution after 60 seconds and drained for 2 minutes. They were again immersed for 60 seconds and withdrawn. The strips were allowed to dry at room temperature for 2 hours and desiccated overnight. Dissections were performed in an ordinary bell jar in the presence of a standard commercial desiccant. The test strips were then reweighed. The data expressed in percent by weight of removal was calculated by subtracting the weight of the treated strip from the weight of the untreated strip and dividing by the weight of the untreated strip.

In this series of test, varying concentrations of Surfonic™ N-95 in d-limonene carrier were assayed for percent asphalt removal. The results are as follows:

| Concentration surfactant | Percent Removal |
|---|---|
| 0.0 | 26.10 |
| 2.0 | 30.74 |
| 2.5 | 32.63 |
| 3.0 | 33.84 |
| 3.5 | 34.96 |
| 4.0 | 35.75 |
| 4.5 | 36.21 |
| 5.0 | 37.16 |
| 5.5 | 38.02 |
| 6.0 | 40.70 |
| 12.0 | 42.68 |

The results indicate that at concentrations of surfactant as low as 2 percent, there is a consistent increase in the amount of asphalt removed up to about 40%. Doubling the concentration at 6% does not improve removal appreciably, so that a range of 2% to 6% is optimal. FIG. 1 is a rectilinear plot of the above data, indicating that a concentration greater than 2% significantly enhances penetration of the carrier into the asphalt.

Example 2

A control experiment was conducted according to the same test protocol. AT10 is a product manufactured by Smith Systems Manufacturing and is believed by its physical properties to be a mixture of petroleum distillates. This product was compared with kerosene, diesel fuel and naphthalene. The percents of asphalt removal were 9.99, 9.17, 9.42, and 9.37 respectively.

What is claimed is:

1. A nonaqueous composition for bituminous substance removal consisting of a mixture of one or more monocyclic monoterpenes, and at least 2% w/w of a surfactant selected from the group consisting of an alkylphenol ethoxylate and an alkyl alcohol ethoxylate or combinations thereof.

2. A nonaqueous composition consisting of a carrier para-menthane diene; and at least 2% w/w of an alkylphenol ethoxylate having the structure

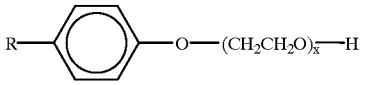

wherein R is a linear alkyl radical $CH_3—(CH_2)_n—$, n is an integer 1–12, and x is an integer 2–23.

3. A nonaqueous composition consisting of a carrier para-menthane diene; and at least 2% w/w of an alkyl alcohol ethoxylate having the structure $$CH_3(CH_2)_x—CH_2—O(CH_2CH_2O)_yH$$

wherein x is an integer 2–16 and y is an integer 2–14.

4. A method of removing asphalt or tar from a solid surface comprising a) providing i) a solid surface having tar or asphalt thereon; and ii) an undiluted nonaqueous mixture consisting of a para-menthane diene and at least 2% w/w of a surfactant selected from the group consisting of an alkylphenol ethoxylate and an alkyl alcohol ethoxylate and combinations thereof; and b) applying said undiluted mixture of a para-menthane diene and at least 2% w/w of a surfactant selected from the group consisting of an alkylphenol ethoxylate and an alkyl alcohol ethoxylate and combinations thereof to said surface under conditions such that said tar or asphalt is removed.

5. The method of claim 4, wherein said conditions comprise incubation at a temperature of about 1–150 degrees Fahrenheit for a time greater than about 2 minutes.

6. The method of claim 4, further comprising step c) rinsing said surface with an aqueous solution.

7. The method of claim 6 together with the additional steps of reapplying said mixture one or more times and incubating after each application before rinsing after the last application.

8. The composition of claim 1 wherein said monocyclic monoterpenes is a para-menthane diene selected from the group consisting of limonene, terpinolene and gamma-terpinene.

9. The composition of claim 1 wherein said alkylphenol ethoxylate is a nonylphenol ethoxylate having a an average of 9.5 ethoxylate linearly repeating residues.

10. The composition of claim 2 wherein said alkylphenol ethoxylate is a nonylphenol ethoxylate having an average of 9.5 ethoxylate linearly repeating residues.

11. The method of claim 4 wherein said solid surface is selected from the group consisting of metal, plastic, painted plastic, painted metal, a ceramic, wood, natural fabric, synthetic fabric, and skin.

12. The method of claim 5 wherein said solid surface is selected from the group consisting of metal, plastic, painted plastic, painted metal, a ceramic, wood, natural fabric, synthetic fabric, and skin.

* * * * *